US006309138B1

(12) United States Patent
Yasu et al.

(10) Patent No.: US 6,309,138 B1
(45) Date of Patent: Oct. 30, 2001

(54) PAVING METHOD AND PAVING MACHINE

(75) Inventors: Hidenori Yasu; Tatsuoki Inagaki; Hajime Sugata; Chiaki Matsuura; Katsuro Hasebe; Ryuzi Izawa; Akio Mori; Nobuyuki Watanabe, all of Tokyo; Fumio Goto; Shinichiro Uchiyama, both of Gumma-ken, all of (JP)

(73) Assignee: Niigata Engineering Co., Ltd., Tokyo (JP)

( * ) Notice: Subject to any disclaimer, the term of this patent is extended or adjusted under 35 U.S.C. 154(b) by 0 days.

(21) Appl. No.: 09/257,531

(22) Filed: Feb. 25, 1999

(30) Foreign Application Priority Data

Feb. 27, 1998 (JP) ..... 10-048210

(51) Int. Cl.[7] ..... E01C 19/10
(52) U.S. Cl. ..... 404/101; 404/118
(58) Field of Search ..... 404/72, 80, 81, 404/86, 101, 104, 105, 108, 110, 118

(56) References Cited

U.S. PATENT DOCUMENTS

| | | | | |
|---|---|---|---|---|
| 3,519,169 | * | 7/1970 | Holland | 404/101 |
| 4,101,237 | | 7/1978 | Catanacci . | |
| 4,405,089 | * | 9/1983 | Taylor | 239/656 |
| 4,749,304 | * | 6/1988 | Craig | 404/101 |
| 5,405,214 | * | 4/1995 | Campbell | 404/80 |
| 5,590,976 | * | 1/1997 | Kilheffer | 404/72 |
| 5,641,249 | * | 6/1997 | McClelland | 404/82 |
| 5,735,634 | | 4/1998 | Ulrich et al. . | |
| 6,050,743 | * | 4/2000 | Medinger | 404/90 |
| 6,086,287 | * | 7/2000 | Sharpe et al. | 404/75 |
| 6,113,310 | * | 9/2000 | Hesse, Jr. | 404/108 |

FOREIGN PATENT DOCUMENTS

| | | |
|---|---|---|
| 23 46 897 A1 | 4/1975 | (DE) . |
| 295 10 058 U1 | 12/1995 | (DE) . |
| 2 697 036 | 4/1994 | (FR) . |
| Hei 9-505370 | 5/1997 | (JP) . |

* cited by examiner

*Primary Examiner*—Thomas B. Will
*Assistant Examiner*—Raymond W Addie
(74) *Attorney, Agent, or Firm*—Fish & Richardson PC

(57) ABSTRACT

Paving materials having excellent durability supplied to a front spreading screw 5 is prevented from dropping onto the center band of a road by a bottom plate 30, and by the rotation of the front spreading screw 5 is spread onto the two bands of the road where the left and right tires of cars make contact. In contrast, an ordinary paving materials supplied to rear spreading screw 7 is prevented from dropping onto the bands of the road with which the left and right tires of cars make contact by means of the bottom plates 32, 33 and is spread onto the center band and the outside bands of the road by the rotation of the rear spreading screw 7. Two types of paving materials spread and formed into alternating bands in this way are laid and paved at the same time by the screed 9, and as a result, a pavement with high durability can be constructed at low cost.

10 Claims, 5 Drawing Sheets

PAVING METHOD AND PAVING MACHINE

BACKGROUND OF THE INVENTION

1. Field of the Invention

The present invention relates to a paving method for paving and laying paving materials such as an asphalt materials onto the surface of a road, and a paving machine which can be used in this method.

This application is based on patent application No. Hei 10-48210 filed in Japan, the content of which is incorporated herein by reference.

2. Description of the Related Art

The machine shown in FIG. 6 has been proposed as a paving machine (Published Japanese Translation No. Hei 9-505370 of PCT International Application). In this paving machine, there are provided, on a self propelled vehicle 81, a front hopper 82 and rear hopper 83 for storing the paving materials, front spreading screw 85 to spread the paving materials Ha sideways, such as an asphalt materials, fed from the front hopper 82 by the feeder (not shown), rear spreading screw 87 to spread sideways the paving materials Hb fed from the rear hopper 83 by the feeder 86, front screed 88 for laying and paving onto the road surface the paving materials Ha spread sideways by the front spreading screw 85, and rear screed 89 for laying and paving the paving materials Hb spread sideways by the rear spreading screw 87. In this paving machine, rear hopper 83, feeder 86 and front screed 88 are added to a conventional paving machine which is provided with front hopper 82, the feeder and rear screed 89.

By using this paving machine, in one paving operation, it is possible to lay and spread on a road surface two types of paving materials Ha and Hb layered in upper and lower layers.

However, conventional paving machines, and the newly proposed paving machine of FIG. 6, have limitations in paving roads of high durability at low cost.

It is therefore the object of the present invention to provide a paving machine and paving method which can pave, at low cost, road surfaces of high durability.

SUMMARY OF THE INVENTION

In order to achieve the above goal, the present invention is constituted so that, as a self propelled vehicle equipped with the hopper and screed moves forward, in the paving method for spreading and laying and paving onto the road surface the paving materials in the hopper using the screed, two or more types of paving materials are spread onto the road surface at the same time by the screed, forming three or more strips alternating sideways, i.e. crossing to the direction of movement of the self propelled vehicle.

By this constitution, for example, it is possible to lay and pave on the road surface an expensive paving materials having excellent durability for the bands where the left and right tires of cars make contact, and an ordinary inexpensive paving materials for the band between said bands and to the outside of said bands. For pavement made according to this method, the durability is improved, because the bands which are prone to wear by the passage of cars can be laid and paved with a paving materials with excellent durability. In addition, by using the expensive paving materials selectively for the bands which are prone to damage, and using inexpensive paving materials for the bands which are not prone to wear, expensive paving materials are economized, and operational expenses are reduced. As a result, according to the present invention, it is possible to lay and pave the paving materials having excellent durability at a low cost.

In the above paving method, it is also possible to use a construction which controls the breadth and/or the position of the paving of the paving materials spread onto the road surface by a spreading screw, by a bottom plate attached to the spreading screw.

By this construction, the width and position of the strips of paving materials can be adjusted easily and precisely by a simple structure.

Further, in order to perform the above paving method, in the present invention, the paving machine on the self propelled vehicle is equipped with a first hopper and a second hopper for storing the paving materials, a front spreading screw for spreading the paving materials supplied from said first hopper sideways, a rear spreading screw for spreading the paving material supplied from said second hopper sideways, and a screed for simultaneously laying and paving the paving materials spread by said front spreading screw and the paving materials spread by said rear spreading screw, and a bottom plate for controlling the breadth and/or position of the spread paving materials are attached to at least one of said front spreading screw and said rear spreading screw.

In this paving machine, the spread width and/or position of the two types of paving materials supplied from the first hopper and second hopper are controlled by the bottom plate, and these two types of paving materials are spread onto the road surface by either spreading screw to form strips alternating sideways, and laid and paved by the screed to make a pavement.

In this paving machine, bottom plates are attached to each of the front spreading screw and the rear spreading screw, and it is preferable to have a total of three bottom plates. In this way, it is possible to lay and pave spreading three to five strips of paving materials, and it is possible to perfectly satisfy the requirements for ordinary paving.

Further, it is possible to make the bottom plates attachable and detachable, and extensible or retractable sideways. If the bottom plates are attachable and detachable, in addition to the above paving method, ordinary paving is also possible. If the bottom plates are constructed to be extensible and retractable sideways, it becomes easy to adjust the width of the spread paving materials. That is to say, by making the bottom plates attachable and detachable, and extensible and retractable sideways, it is possible to respond precisely and easily to a wide range of paving requirements.

DESCRIPTION OF THE PREFERRED EMBODIMENTS

Figure 1:
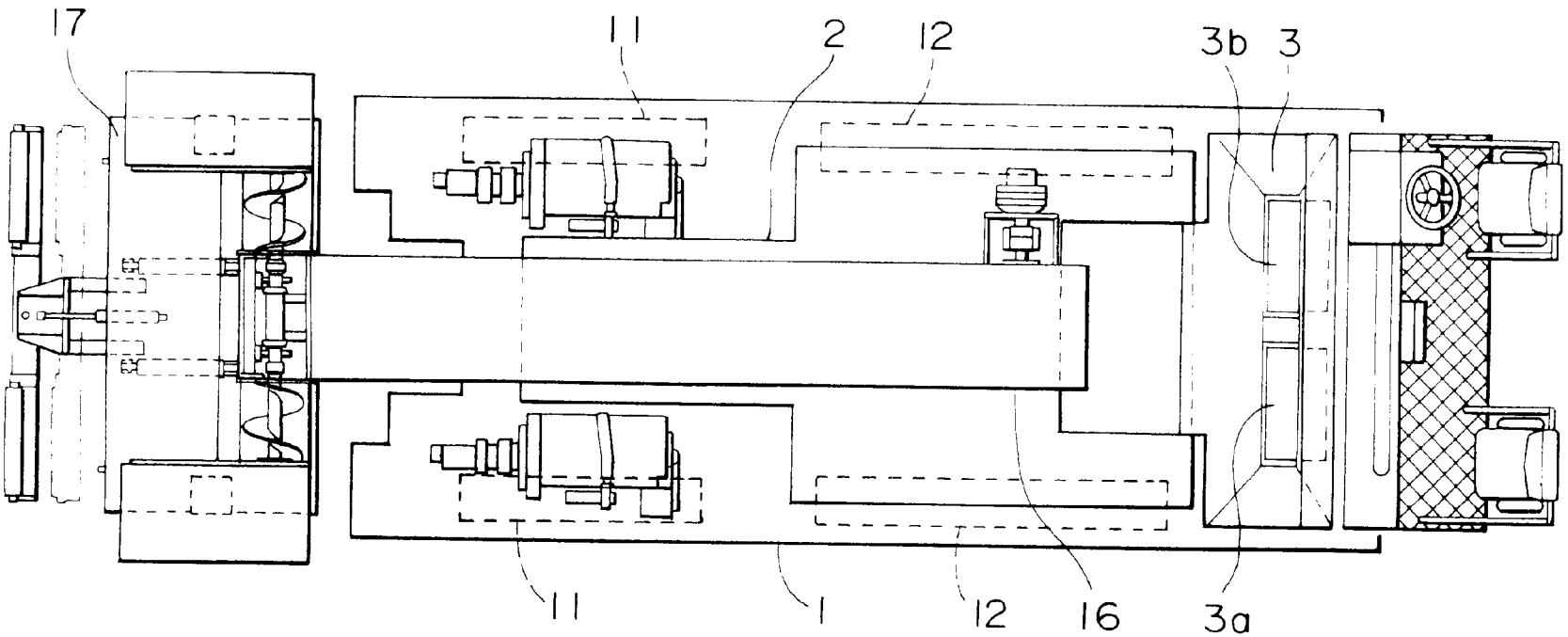
FIG. 1 is a plan view showing an embodiment of the present invention.

An embodiment of the present invention will be explained with reference to FIGS. 1 and 5.

Reference number 1 is a self propelled vehicle. Self propelled vehicle 1 is equipped with front hopper 2, rear hopper 3, a left and right pair of front spreading screws 5 to spread sideways the paving materials Ha fed by the left and right pair of bar feeders 4 from the front hopper 2, a left and right pair of rear spreading screws 7 to spread sideways the paving materials Hb discharged from the rear hopper 3, a screed 9 to lay and pave on the road surface the paving materials Ha and Hb spread by the front spreading screws 5 and rear spreading screws 7, and loading feeder 16 to load into front hopper 2 and rear hopper 3 the paving materials transferred from a dump truck to receiving hopper 17.

Figure 2:
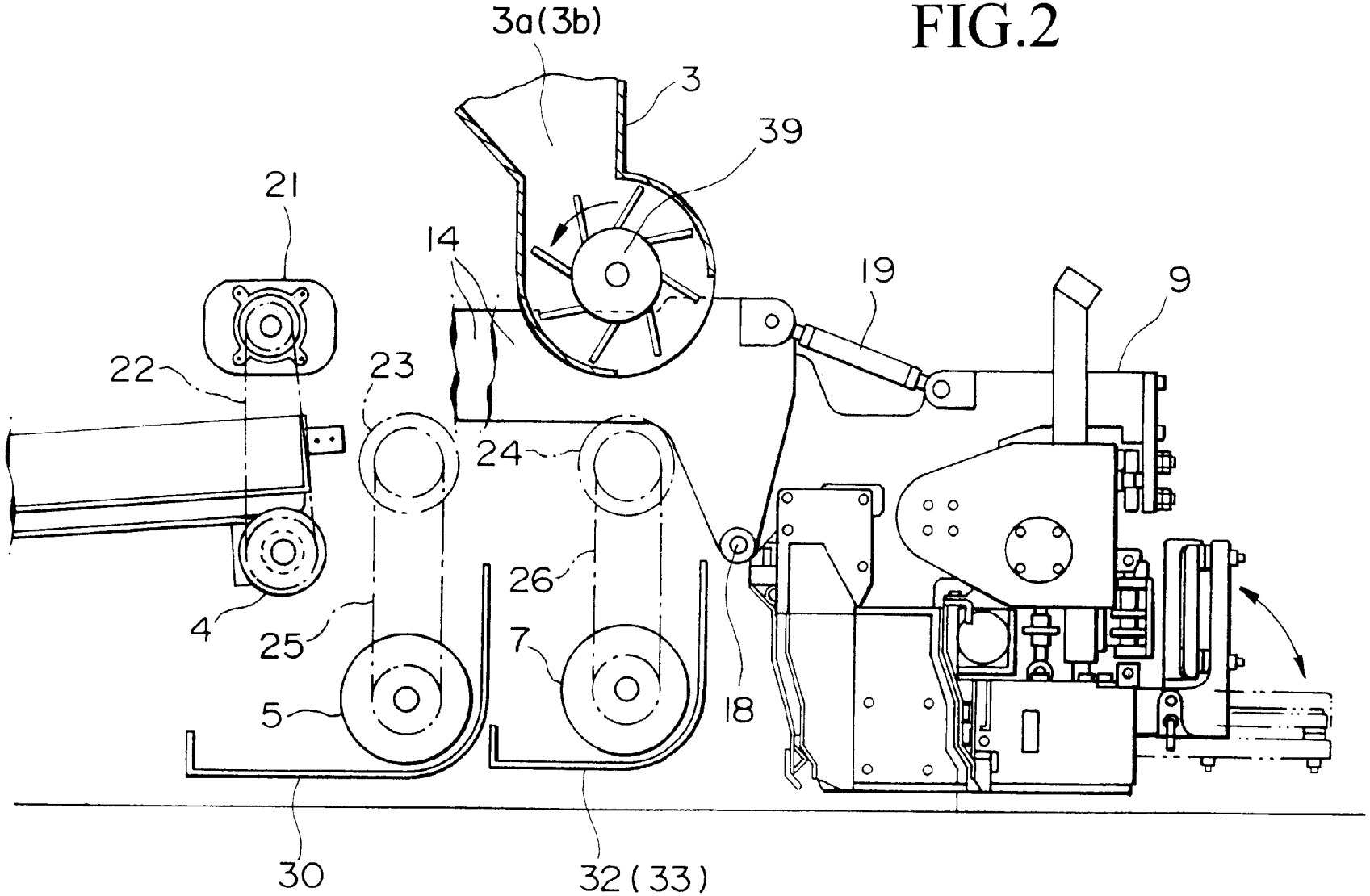
FIG. 2 is a side view of the main parts showing the relationship between the spreading screw and the bottom plate and other parts.
Figure 3:
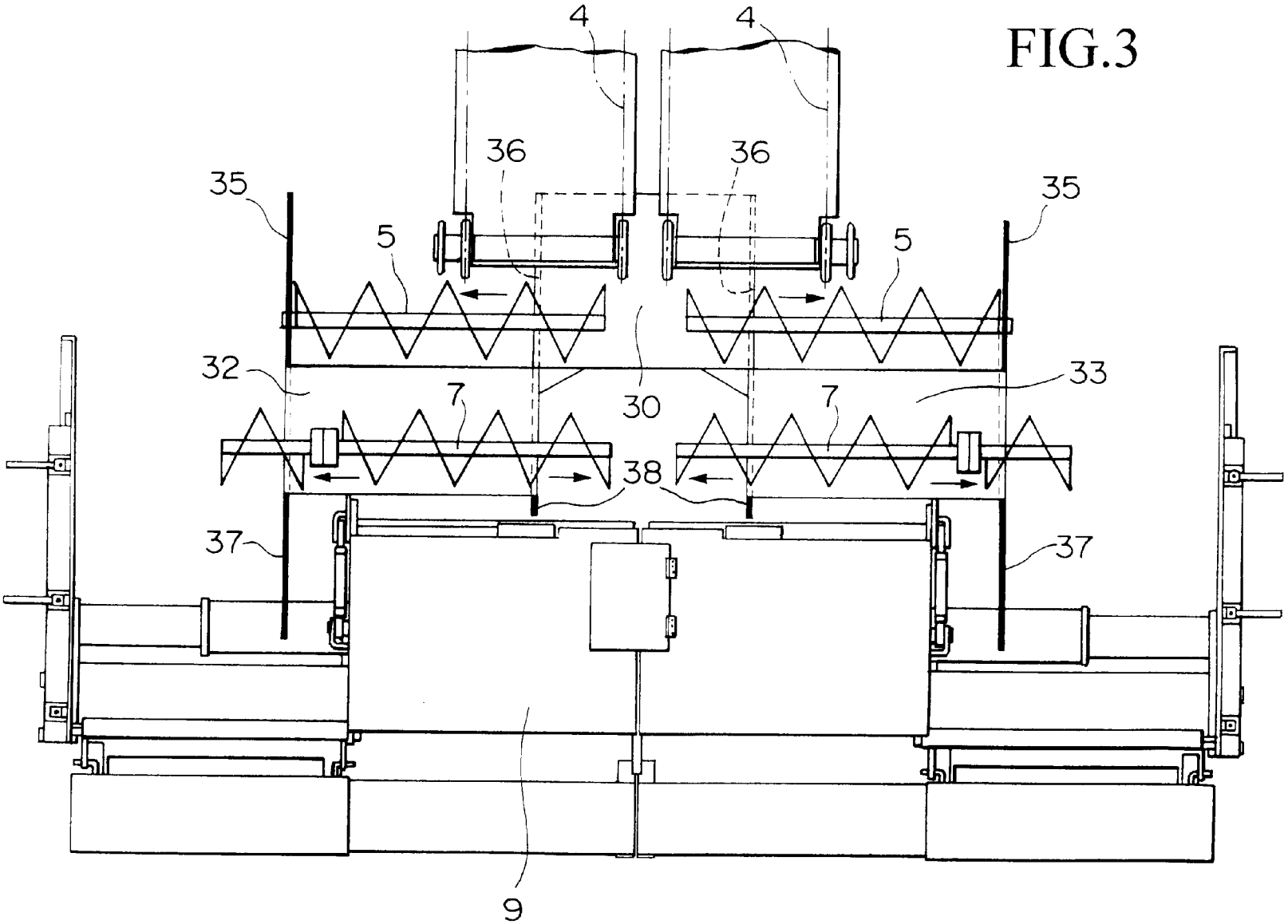
FIG. 3 is a plan view of the main parts showing the relationship between the spreading screw and the bottom plate and other parts.
Figure 4:
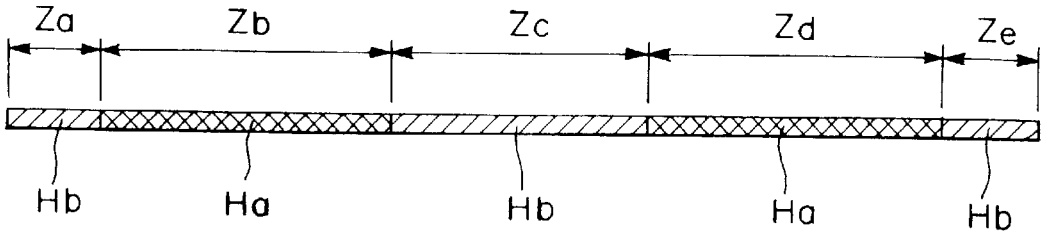
FIG. 4 is a cross sectional view of a case in which two types of paving materials are laid and paved in five bands.

The self propelled vehicle 1 has pairs of left and right pairs of crawlers 11 and 12 and is designed to be propelled by their driving force. Bar feeders 4, 4 are each connected to driving motor 21, for driving them, by an transmission means 22 such as a chain. Further, front spreading screws 5, 5 and rear spreading screws 7, 7 are each connected to driving motors 23, 23, 24, 24 (FIG. 2 shows only the parts on the closer side), for driving them by means of transmission means 25, 26 such as chains, to make them revolve to transfer the paving materials in the direction of the arrow of FIG. 3. Driving motors 21, 23 and 24 are variable speed hydraulic or electric motors, and are supported, with spreading screws 5, 7, by the self propelled vehicle 1. Further, the screed 9 is made extensible and retractable, and is suspended at the end of a left and right pair of leveling arms 14 (see FIG. 2) by means of axle 18 and turnbuckle 19.

Reference number 30 is the bottom plate provided under the front spreading screws 5, 5. Bottom plate 30 is disposed to be centered sideways under the front spreading screws 5, 5, and prevents the paving materials Ha fed from the bar feeders 4, 4 from falling onto the center band Zc which is at the center of the bands Za, Zb, Zc, Zd, and Ze which are lined up crossing to the direction of movement of the self propelled vehicle 1, and allows the paving materials to fall onto the bands Zb and Zd to the right and left of band Zc.

Reference numbers 32 and 33 are bottom plates respectively provided under the rear spreading screws 7, 7. Bottom plate 32 is disposed to be centered sideways under the rear spreading screw 7 shown in the left side of FIG. 3, and prevents the paving materials Hb which has dropped from the opening 3*a* located at the left side of the rear hopper 3 (in the lower part of FIG. 1) from falling onto the band Zb, and allows the paving materials Hb to fall onto bands Za and Zc located at the right and left sides of band Zb. Bottom plate 33 is disposed to be centered sideways under the rear spreading screw 7 shown in the right side of FIG. 3, and prevents the paving materials Hb which has dropped from the opening 3*b* on the right side of the rear hopper 3 from falling onto the band Zd, and allows the paving materials Hb to fall onto bands Zc and Ze to the right and left of band Zb.

At the outer edges of front spreading screw 5 and bottom plate 30, and at the outer and inner edges of bottom plates 32 and 33, there are provided partitioning plates 35, 36, 37, and 38. Partitioning plate 35 prevents the paving materials Ha from spreading to the bands Za and Ze, and partitioning plates 36, 37 and 38 prevent the paving materials Ha and Hb from mixing into adjoining bands.

Each of the openings 3*a* and 3*b* of the rear hopper is provided with a vaned roll 39 which is made to rotate by a variable speed motor (not shown in the figures) to make the paving materials Ha drop. Each bottom plate 30, 32 and 33, and partitioning plate 35 is mounted onto the self propelled vehicle 1 by a mounting means such as a bolt (not shown), so that their positions can be controlled, and so that they can be removably attached. Further, partitioning plates 36, 37, and 38 are mounted onto the bottom plates 30, 32 and 33.

Figure 5:
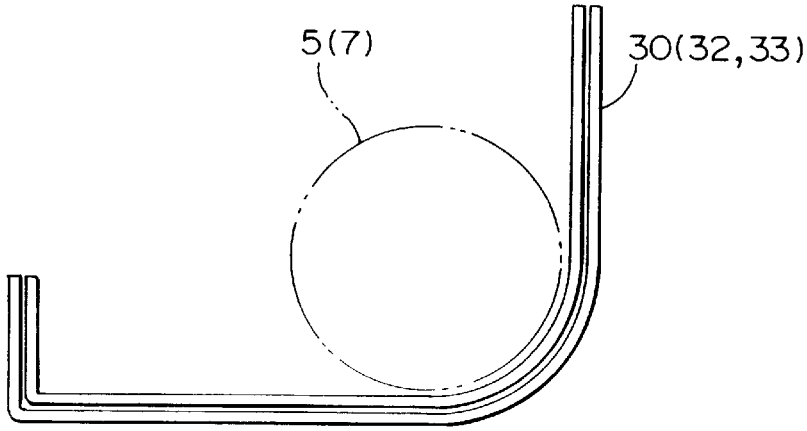
FIG. 5 is a side view showing an example of an extensible and retractable bottom plate.

Furthermore, bottom plates 30, 32 and 33, as shown in FIG. 5, can have a extensible and retractable multiple layer structure (a two layer structure is shown in the figure). With this structure, it is possible to freely set the widths of each of the bands Za–Ze.

Next, the operation of a paving machine having the above constitution will be explained.

In a paving operation of a paving materials such as an asphalt mixture or the like, ordinarily, an expensive paving materials Ha having excellent durability is loaded into the front hopper 2, and an ordinary, inexpensive paving materials Hb is loaded into the rear hopper 3. Then, as the self propelled vehicle 1 moves forward, the paving materials Ha in the front hopper 2 is fed by the bar feeders 4, 4 to the front spreading screws 5, 5, and the paving materials Hb in the rear hopper 3 is dropped from the openings 3*a* and 3*b* to the rear spreading screws 7, 7.

The paving materials Ha supplied to the front spreading screws 5, 5 is prevented from dropping onto the band Zc by the bottom plate 30, and is spread onto the bands Zb and Zd by the rotation of the front spreading screws 5, 5. Further, the paving materials Hb supplied to the rear spreading screws 7, 7 is prevented from dropping onto the bands Zb and Zd by the bottom plates 32, 33, and is spread onto the bands za, zc and Ze by the rotation of the rear spreading screws 7, 7.

In this way, two types of paving materials Ha and Hb, spread to form alternating bands Za–Ze, are laid and paved by screed 9, and a pavement is completed.

The amount of paving materials Ha and Hb supplied to each of spreading screws 5 and 7 is controlled by changing the transfer speed of the bar feeders 4, 4, and the rotation speed of the rolls 39, 39. Further, the width and position of each of bands Za–Ze can be controlled by such means as replacing any of the bottom plates 30, 32 and 33 with wider or narrower plates, extending or retracting them, or possibly by laterally shifting them.

It is also possible to carry out ordinary paving by removing all of the bottom plates 30, 32 and 33. In this case, paving can be done by using both front hopper 2 and rear hopper 3, and paving by layering two types of paving materials Ha and Hb, or by using one hopper and paving one type of paving materials.

The present invention, in addition to the constitution shown in the figures, can also be modified as below.

(1) In the case that expensive paving materials having excellent durability are paved only on the bands where the left and right tires of cars make contact with the road surface, it is most common for the total number of bottom plates attaches to the front spreading screws 5, 5 and the rear spreading screws 7, 7 to be three. However, contrary to what is shown in the figures, it is possible for the front spreading screws 5, 5 to have two bottom plates attached to them, or for the rear spreading screws 7, 7 to have one bottom plate attached to them.

(2) The number of bottom plates can be changed in response to the type of paving materials or the like, and is not limited to a set of three, and one or more bottom plates can be used.

(3) It is possible to use three or more types of paving materials.

Figure 6:
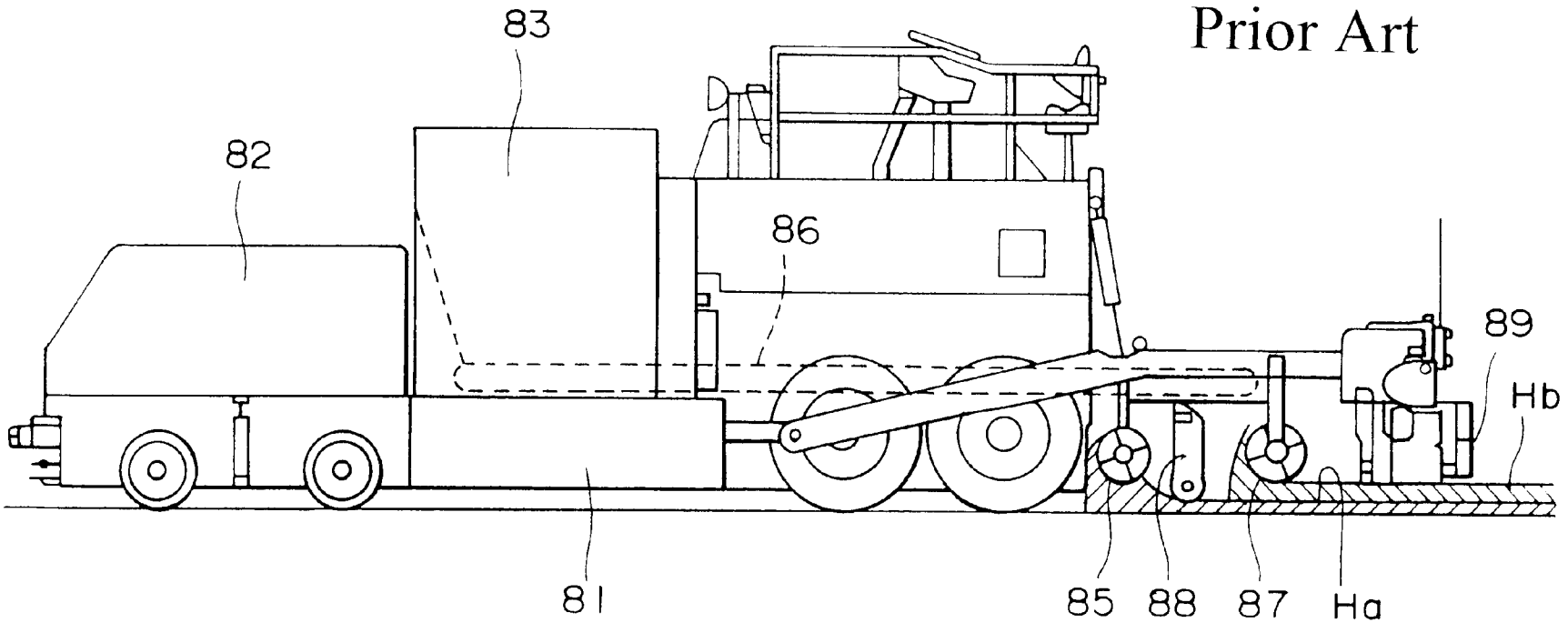
FIG.6 Prior Art
FIG. 6 is a side view of a conventional paving machine.

(4) The paving materials in rear hopper 3 can be transferred to the rear spreading screws 7, 7 by a feeder as shown in FIG. 6.

(5) The partitioning plates and the bottom plates can be moved sideways in correspondence with the extension and retraction of the screed 9.

What is claimed is:

1. A paving machine comprising a self propelled vehicle including:

a first hopper and a second hopper for storing paving materials, a front spreading screw extending sideways for spreading the paving materials supplied from said first hopper, a rear spreading screw extending sideways for spreading the paving materials supplied from said second hopper, wherein the rear spreading screw has a different length from the front spreading screw, a screed to lay and pave at the same time the paving materials spread by said front spreading screw and said rear spreading screw, and one or more bottom plates attached to at least one of the spreading screws for controlling at least either the spreading width or the position of the paving materials.

2. The paving machine of claim 1, wherein said one or more bottom plates are removable and attachable.

3. The paving machine of claim 1, wherein said one or more bottom plates have structures that can extend and retract in the right and left directions, perpendicular to the direction of movement of the paving machine.

4. The paving machine of claim 2, wherein said one or more bottom plates have structures that can extend and retract in the right and left directions, perpendicular to the direction of movement of the paving machine.

5. A paving machine comprising a self propelled vehicle including:

a first hopper and a second hopper for storing paving materials, a front spreading screw extending sideways for spreading the paving materials supplied from said first hopper, a rear spreading screw extending sideways for spreading the paving materials supplied from said second hopper, wherein the rear spreading screw has a different length from the front spreading screw, a screed to lay and pave at the same time the paving materials spread by said front spreading screw and said rear spreading screw, and bottom plates attached to the spreading screws for controlling at least either the spreading width or the position of the paving materials.

6. The paving machine of claim 5, wherein said bottom plates are removable and attachable.

7. The paving machine of claim 5, wherein said bottom plates have structures that can extend and retract in the right and left directions, perpendicular to the direction of movement of the paving machine.

8. The paving machine of claim 6, wherein said bottom plates have structures that can extend and retract in the right and left directions, perpendicular to the direction of movement of the paving machine.

9. A paving method in which, as a self propelled vehicle equipped with a screed and hoppers moves forward, paving materials contained in the hoppers are spread onto a road surface and laid and paved by the screed, the method comprising:

providing each of two or more types of paving materials from said hoppers onto each of a plurality of spreading screws having different lengths and extending along right and left directions with a first one of the spreading screws located behind a second one of the spreading screws with respect to a direction of movement of the self propelled vehicle;

laying said paving materials onto the road surface by rotating said spreading screws to form three or more strips alternating from right to left in a direction perpendicular to the direction of movement of the self propelled vehicle; and paving said three or more strips at the same time by the screed.

10. The paving method according to claim 9 including controlling at least either the spreading width or the position of the paving materials that are spread onto the road surface by one or more bottom plates attached to at least one of the spreading screws.

* * * * *